US007911396B2

(12) United States Patent
Rudant

(10) Patent No.: US 7,911,396 B2
(45) Date of Patent: Mar. 22, 2011

(54) MEANDERED ANTENNA

(75) Inventor: Lionel Rudant, Grenoble (FR)

(73) Assignee: Radiall, Rosny-Sous-Bois (FR)

( * ) Notice: Subject to any disclaimer, the term of this patent is extended or adjusted under 35 U.S.C. 154(b) by 120 days.

(21) Appl. No.: 11/920,834

(22) PCT Filed: May 30, 2006

(86) PCT No.: PCT/FR2006/050492
§ 371 (c)(1),
(2), (4) Date: Feb. 20, 2008

(87) PCT Pub. No.: WO2007/003827
PCT Pub. Date: Jan. 11, 2007

(65) Prior Publication Data

US 2008/0284657 A1 Nov. 20, 2008

(30) Foreign Application Priority Data

Jun. 2, 2005 (FR) ..... 05 51484

(51) Int. Cl.
*H01Q 1/24* (2006.01)

(52) U.S. Cl. ..... 343/702; 343/806

(58) Field of Classification Search ..... 343/700 MS, 343/895, 702, 804, 806, 803, 792
See application file for complete search history.

(56) References Cited

U.S. PATENT DOCUMENTS

| | | | | |
|---|---|---|---|---|
| 3,134,979 | A * | 5/1964 | Bell | 343/792.5 |
| 3,369,243 | A * | 2/1968 | Greiser | 343/770 |
| 5,754,143 | A | 5/1998 | Warnagiris et al. | |
| 5,867,126 | A * | 2/1999 | Kawahata et al. | 343/702 |
| 6,094,170 | A | 7/2000 | Peng | |
| 6,111,545 | A | 8/2000 | Saari | |
| 6,255,999 | B1 | 7/2001 | Faulkner et al. | |
| 6,285,331 | B1 | 9/2001 | Jesman et al. | |
| 6,642,893 | B1 * | 11/2003 | Hebron et al. | 343/702 |
| 2002/0080088 | A1 | 6/2002 | Boyle | |
| 2003/0210188 | A1 | 11/2003 | Hebron et al. | |
| 2004/0145523 | A1 | 7/2004 | Shamblin et al. | |

FOREIGN PATENT DOCUMENTS

| | | | |
|---|---|---|---|
| EP | 1 351 334 | A | 10/2003 |
| WO | WO 2004/025778 | A1 | 3/2004 |

OTHER PUBLICATIONS

Oct. 5, 2009 European Office Action for corresponding European application No. 06794470.2 with computer-generated translation.

* cited by examiner

*Primary Examiner* — Jacob Y Choi
*Assistant Examiner* — Kyana R Robinson
(74) *Attorney, Agent, or Firm* — Oliff & Berridge, PLC

(57) ABSTRACT

The invention concerns a meandered antenna comprising: a first meandered conductive element including a plurality of arms, two consecutive arms forming a meander; a second conductive element forming with the first conductive element a radiating two-wired line, the second conductive element including a plurality of arms engaged each between two consecutive arms of the first conductive element. The antenna is characterized in that it is designed to operate without ground element, in particular without ground plane.

15 Claims, 1 Drawing Sheet

MEANDERED ANTENNA

Figure 1:
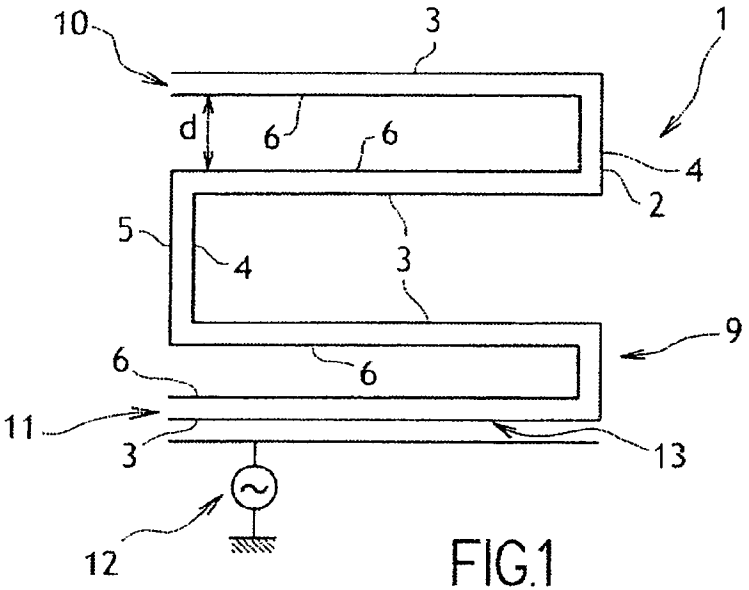

The present invention relates to a meandered antenna.

Many types of meandered antennas are already known.

The US patent application 2004/0145523 discloses a magnetic dipole antenna coupled to a ground plane.

The U.S. Pat. No. 6,094,170 discloses an antenna comprising a dielectric plate on which a "microstrip" line is provided, comprising a ground formed on the back of the plate.

The U.S. Pat. No. 5,754,143 discloses an antenna comprising a conductive sheet on which a meandered slit is provided.

The U.S. Pat. No. 6,255,999 discloses an antenna comprising radiating elements arranged in zigzags.

The U.S. Pat. No. 6,111,545 discloses an antenna comprising a meandered-shaped conductor, with a return at one end.

The present invention notably aims to propose a meandered antenna presenting relatively low bulkiness, while ensuring a satisfying radiating efficiency.

The invention thereby concerns a meandered antenna comprising:

- a first meandered conductive element including a plurality of arms, two consecutive arms forming a meander,
- a second conductive element forming with the first conductive element a radiating two-wired line, the second conductive element including a plurality of arms each engaged between two consecutive arms of the first conductive element.

The term "meandered" can notably describe a continuous curve without branch point and presenting a base pattern, an alternative of a base pattern or various base patterns repeated successively in a predetermined direction.

For example, at least one of the first and second conductive elements can present a rectangular meandered shaped.

The present invention enables a miniaturized antenna to be obtained which has a completely satisfactory radiating efficiency, compared with known meandered antennas, without a two-wired line, due notably to the increase in the effective area in the case of the antenna according to the present invention.

Further, the antenna according to the present invention, with a two-wired line, can be advantageously arranged to operate without a ground element, which enables to further reduce the bulkiness of the antenna.

Thereby, advantageously, the antenna is not connected with a ground element.

The antenna can be of transmitter/receiver type.

The antenna according to the present invention can be arranged, if necessary, to operate in a predetermined frequency range, and not in several dissociated frequency ranges.

The antenna can be arranged to operate in a range between 50 MHz and 150 MHz, for example between 80 MHz and 100 MHz.

The antenna according to the present invention can comprise parasitic elements made up for example of one or more metal tapes of various geometrical shapes that can be built into a pattern, these elements being able to be continuous or discontinuous in order to increase the effective area.

In an exemplary embodiment of the present invention, the two-wired line presents two ends, the first and second conductive elements being arranged in an open circuit at the two ends of this two-wired line.

Further, the first and second conductive elements are arranged in a short circuit at one of the ends of the two-wired line, and in an open circuit at the other end.

Further still, the first and second conductive elements are arranged in a short circuit at both ends of the two-wired line.

In an exemplary embodiment of the present invention, the second conductive element comprises at least two consecutive arms, notably substantially parallel, forming a meander of the second conductive element, these two arms each engaged between two consecutive arms of the first conductive element.

The first and second conductive elements can for example be extended according to parallel paths, substantially over their whole length.

In another exemplary embodiment of the present invention, the second conductive element comprises an arm extending between two consecutive arms of the first conductor element, said arm of the second conductive element defining with each of said arms of the first conductive element a portion of the two-wired line.

In other words, the two consecutive arms of the first conductive element share one same portion of the second conductive element to form the two-wired line locally.

Preferably, at least one of the conductive elements, notably each of the two conductive elements, comprises a conductive wire or is formed by a conductive track on an isolating substrate. For example, at least one of the conductive elements can be formed by a conductive track of a printed circuit board.

The conductive elements of the antenna can be metallic.

Advantageously, the two-wired line of the antenna is supplied by a capacitive coupling.

When the two-wired line presents at least one end in an open circuit, the antenna is preferably supplied on one side of the two-wired line, substantially adjacent to said end in an open circuit, by the capacitive coupling.

When the two-wired line presents two ends in a short circuit, the antenna is advantageously supplied on one side of the two-wired line, away from the ends thereof, by the capacitive coupling, which side can be for example substantially located in a central area of the two-wired line.

The impedance adaptation is ensured by energising the antenna through a series capacitance, which can be obtained for example by using two parallel metallic conductors between which one applies a difference in potential for the energising.

The two-wired line advantageously presents a length in an unfolded state close to, or a multiple of, a quarter of the wavelength corresponding to the resonance frequency of the antenna.

Figure 2:
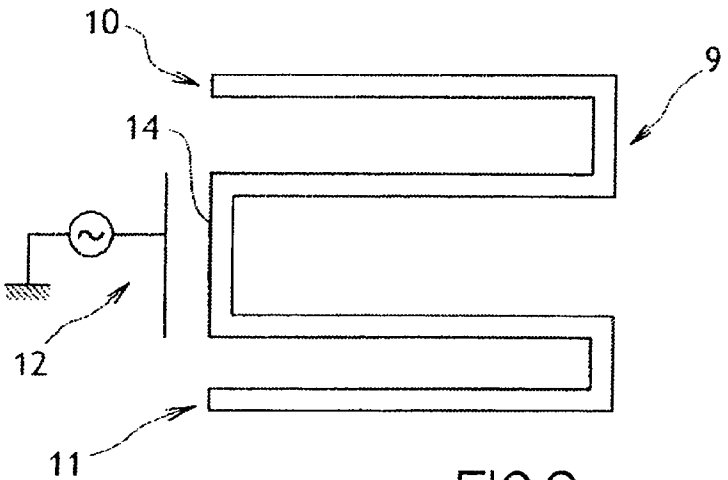
Figure 3:
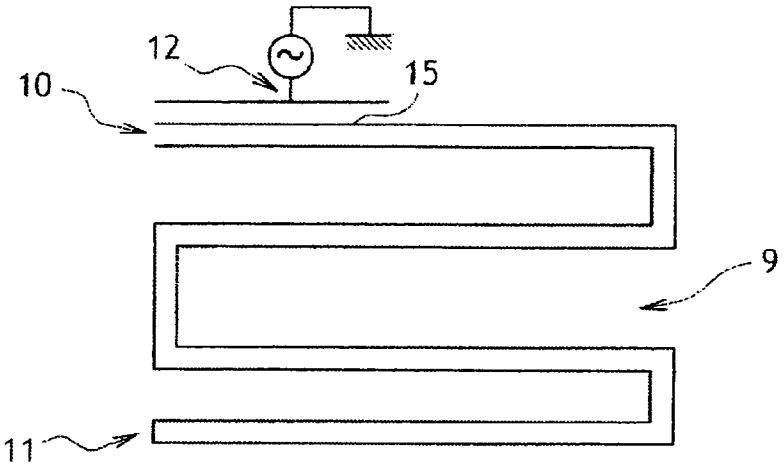
Figure 4:
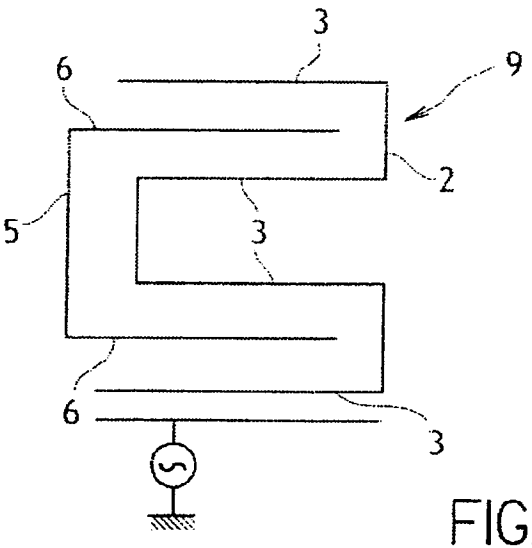

The present invention can be better understood by referring to the detailed disclosure hereinafter, of examples of non-restrictive embodiments of the present invention, and to the annexed drawing, in which:

FIG. 1 shows, schematically and partially, an antenna according to the present invention, and FIGS. 2 to 4 show, schematically and partially, antennas according to alternative embodiments of the present invention.

FIG. 1 shows a meandered antenna 1 according to the present invention, that can be used for example in the following fields: portable telephones, televisions, radios, etc The antenna 1 comprises a first conductive element 2 presenting a plurality of arms 3 in pairs forming meanders, these arms 3 being straight and connected in pairs by a straight portion 4 perpendicular to the arms 3.

The first conductive element 2 thereby presents a rectangular meandered shape.

The arms 3 can be parallel, as illustrated in FIG. 1.

In a non-illustrated alternative of the present invention, the arms 3 can be arranged one to another in a slanted manner, not parallel, by forming for example at each joint of two consecutive arms 3 a rounded bend.

The antenna 1 comprises a second conductive element 5 forming with the first conductive element 2 a radiating two-wired line 9.

The second conductive element 5 presents, in the example considered, a rectangular meandered shape, like the first conductive element 2, the first and second conductive elements 2 and 5 extending according to parallel paths substantially over their whole length.

The second conductive element 5 comprises arms 6 each engaged in pairs between two consecutive arms 3 of the first conductive element 2.

Two arms 6 of the second conductive element 5, extending in a meandered area, between two arms 3 of first conductive element 2, are separated by a non-null distance D.

The first and second conductive elements 2 and 5 can present substantially the same length, corresponding to the length of the two-wired line.

The first and second conductive elements 2 and 5 can each be formed by a conductive track of a printed circuit board.

Alternatively, the first and second conductive elements 2 and 5 can be formed by metallic wires for example.

The two-wired line 9 presents two ends 10 and 11.

In the example illustrated in FIG. 1, the two-wired line 9 is open at the two ends 10 and 11, being supplied by a capacitive coupling 12, at one side 13 of the two-wired line 9, adjacent to one of the ends 10 and 11.

Further, as illustrated in FIG. 2, the two-wired line 9 is in a short circuit at its two ends 10 and 11, the two-wired line 9 being supplied by a capacitive coupling 12, on a side 14 of the line 9 substantially located in a central area thereof.

Further still, as illustrated in FIG. 3, the two-wired line 9 is in a short circuit at one 11 of the ends and in an open circuit at the other 10 end, this line being supplied by a capacitive coupling 12, at a side 15 of the line 9, adjacent to the end 10 in an open circuit.

The present invention enables to reduce the above-mentioned distance d, between two consecutive arms 6 of the conductive element 5 until these arms 6 are merged.

As illustrated in FIG. 4, the second conductive element 5 can comprise a plurality of arms 6 each extending between two consecutive arms 3 of the first conductive element 2, each arm 6 defining with each arm 3 located on either side of the arm 6 a portion of the two-wired line 9.

The present invention thereby enables to considerably reduce the bulkiness of the antenna while ensuring a satisfying radiating efficiency.

The invention claimed is:

1. An assembly comprising:

a meandering antenna, comprising:

a first meandered conductive element comprising a plurality of arms, two consecutive arms forming a meander, a second conductive element forming a radiating two-wired line with the first conductive element, the second conductive element comprising a plurality of arms each engaged between two consecutive arms of the first conductive element; and a power supply removably capacitively coupled to the antenna, wherein the antenna is physically disconnected from a ground element.

2. The assembly according to claim 1, the two-wired line presenting two ends, wherein the first and second conductive elements are arranged in an open circuit at the two ends of the two-wired line.

3. The assembly according to claim 1, the two-wired line presenting two ends, wherein the first and second conductive elements are arranged in a short circuit at one of the ends of the two-wired line and in an open circuit at the other end.

4. The assembly according to claim 1, the two-wired line presenting two ends, wherein the first and second conductive elements are arranged in a short circuit at the two ends of the two-wired line.

5. The assembly according to claim 1, wherein the second conductive element comprises at least two consecutive arms, forming a meander of the second conductive element, the at least two consecutive arms being substantially parallel with each being engaged between two consecutive arms of the first conductive element.

6. The assembly according to claim 1, wherein the first and second conductive elements extend according to parallel paths substantially over their whole length.

7. The assembly according to claim 1, wherein the second conductive element comprises an arm extending between two consecutive arms of the first conductive element, the arm of the second conductive element defining with each of the arms of the first conductive element a portion of the two-wired line.

8. The assembly according to claim 1, wherein the first conductive element presents a rectangular meandered shape.

9. The assembly according to claim 1, wherein at least one of the conductive elements comprises a conductive wire.

10. The assembly according to claim 1, wherein at least one of the conductive elements is formed by a conductive track on an isolating substrate.

11. The assembly according to claim 1, the two-wired line presenting at least one end in an open circuit, wherein the antenna is supplied on one side of the two-wired line, substantially adjacent to the end in an open circuit, by the capacitive coupling.

12. The assembly according to claim 1, the two-wired line presenting two ends in a short circuit, wherein the antenna is supplied on one side of the two-wired line, away from the ends thereof, by the capacitive coupling.

13. The assembly according to claim 12, wherein the one side of the capacitive coupling is substantially located in a central area of the two-wired line.

14. The assembly according to claim 1, wherein each of the two conductive elements comprises a conductive wire.

15. The assembly according to claim 1, wherein each of the two conductive elements is formed by a conductive track on an isolating substrate.

* * * * *